United States Patent [19]

Merendino et al.

[11] Patent Number: 5,074,604

[45] Date of Patent: Dec. 24, 1991

[54] DOOR KNOB AND LATCH RETAINING DEVICE

[75] Inventors: Paul A. Merendino, Mogadore; Fred I. Albrecht, Akron, both of Ohio

[73] Assignee: Albrecht, Inc., Akron, Ohio

[21] Appl. No.: 626,203

[22] Filed: Dec. 10, 1990

[51] Int. Cl.[5] ..... B05C 19/18

[52] U.S. Cl. ..... 292/258; 292/288; 292/256.63; 292/349

[58] Field of Search ..... 16/114 R, 1 R; 292/256.63, 288, 258, 347-349, DIG. 2, 336.3, 350, DIG. 8

[56] References Cited

U.S. PATENT DOCUMENTS

| | | | |
|---|---|---|---|
| 185,760 | 12/1876 | Kinsman | 292/359 |
| 3,141,692 | 7/1964 | Behrens | 292/147 |
| 3,306,643 | 2/1967 | Reed | 292/1 |
| 3,458,228 | 7/1969 | White | 292/288 |
| 3,960,396 | 6/1976 | Miyahara | 292/DIG. 2 |
| 3,994,608 | 11/1976 | Swiderski et al. | 292/349 |
| 4,397,489 | 8/1983 | Lind | 292/DIG. 2 |
| 4,913,479 | 4/1990 | Allison | 292/DIG. 2 |
| 5,004,279 | 4/1991 | Radcliff | 292/288 |

*Primary Examiner*—Eric K. Nicholson
*Assistant Examiner*—Darnell Boucher
*Attorney, Agent, or Firm*—Oldham & Oldham

[57] ABSTRACT

The disclosure describes a latch retaining device to maintain the latch of a door in an inoperable position, which includes at least one body member adapted to engage and grip the door knob of the door so as to retain the door knob in its latch releasing rotated position indefinitely. The body member of the device may have first and second ends with the first end thereof adapted to frictionally engage the door adjacent the position of the door knob, whereby frictional engagement between the device and the door as well as the door knob enable the door knob to be maintained in a position to render the door latch inoperative. Alternatively, the body member may frictionally engage a door knob and exert an appropriate force thereon to maintain it in a latch releasing position. The at least one body member is secured in its frictionally engaging position by means of a cincturing strap associated with the body member. The body member is adapted to frictionally engage any variety of door knob and to assuredly allow the door knob to be maintained in its latch releasing rotated position. The at least one body member may be provided with various structures to facilitate placement of device in its operative position on a door knob to enable easy and effective use of the device. The device provides a simple and cost effective structure to maiantain a door latch in an inoperative position for free movement of the door as desired under many circumstances.

20 Claims, 4 Drawing Sheets

DOOR KNOB AND LATCH RETAINING DEVICE

BACKGROUND OF INVENTION

This invention generally relates to a device which allows the latch of a door to be retained in an open position by securing the knob of the door in a latch releasing turned open position. More specifically, the invention relates to a device which will frictionally engage the door knob and door itself so as to retain the door knob in its turned open position to thereby retain the latch mechanism in an open condition to prevent the door from latching when closed.

Under many circumstances, it may be desirable to render the latch of a door inoperative to prevent latching of the door when in a closed position. For example, the elderly or physically impaired may find it difficult to turn the knob of a door to unlatch a door for opening. At the same time, it may not be desired to permanently render the latch of the door unusable, as latching of the door may be desired for security purposes or to assuredly maintain the door in a closed position.

In another aspect, there have been developed automatic door openers of various types. In a commercial setting, the doors of a store or the like may not have a knob and latch system as is found on household doors or the like. In these situations, the door may be simply locked by a deadbolt or similar mechanism, which after retraction will allow an automatic door to operate accordingly. In such a situation, there is no need for means to retract a latch mechanism to affect opening of a door. On the other hand, in a door having a latch system and turnable knob to retract the latch, an automatic door opening device will only be operable if the door is maintained in an open condition to prevent latching thereof or if the latch can be selectively unlatched upon operation of the opening device or if the latch is rendered inoperative. A door opening the closing device suitable for use in the home or commercial environments is shown in co-pending U.S. application Ser. No. 394,561, now allowed, which includes a latch control means acting to automatically unlatch the door upon initiation of the device to open the door. In this respect, the particular latch release mechanism used with the opening device may be of any known configuration to be electrically actuated by the device. Various latch release control apparatus are known such as is shown in U.S. Pat. Nos. 3,188,129, 3,910,617, 3,804,442, and 4,529,234. Although providing an electrical release mechanism for the latch assembly of a door enables selective operation of the latch when desired, such systems add significantly to the expense and complexity of a door opening assembly and may be susceptible to malfunction thereby resulting in failure of the system and additional costs.

SUMMARY OF THE INVENTION

Based upon the foregoing, it is a main object of the invention to provide a door latch retaining device usable with doors having knobs for releasing the latch mechanism, whereby the device retains the door knob and therefore the latch mechanism in an opened condition to prevent latching of the door when in the closed position for free operation thereof.

It is a further object of the invention to provide a door latch retaining device which is simple in its construction and use, and yet effectively inhibits latching of a door when desired, and is advantageously utilized in association with an automatic door opening and closing device which is operated remotely.

It is yet another object of the invention to provide a latch retaining mechanism which acts to retain the door knob in its latch releasing rotated position by means of frictional engagement of the device of the invention and the door and door knob on which it is utilized. Alternatively, a force may be applied to maintain a door knob in a latch releasing positioned by means of the device without frictional engagement with the door itself.

It is another object of the invention to provide a latch retaining mechanism used on doors having door knobs, wherein the latch retaining mechanism is used in association with the door knob and is adaptable to any variety of door knob so as to maintain the door latch in an open position.

A further object of the invention is to provide a latch retaining mechanism which is adapted to be utilized in association with a door knob and allows a great amount of flexibility in positioning the device so as to retain the door latch in an open condition.

These and other objects and advantages of the invention are accomplished by means of a latch retaining device to maintain the latch of a door in an inoperable position, which includes at least one body member adapted to engage each end and grip the door knob of the door so as to retain the door knob in its latch releasing rotated position indefinitely. The body member of the device may have first and second ends with the first end thereof adapted to frictionally engage the door adjacent the position of the door knob, whereby frictional engagement between the device and the door as well as the door knob enable the door knob to be maintained in a position to render the door latch inoperative. Alternatively, the body member may frictionally engage a door knob and exert an appropriate force thereon to maintain it in a latch releasing position. The at least one body member is secured in its frictionally engaging position by means of a cincturing strap associated with the body member. The body member may be a toroidal section having various inner surfaces which allow the body member to be adapted to frictionally engage any variety of door knob and to assuredly allow the door knob to be maintained in its latch releasing rotated position. The at least one body member may be provided with various structures to facilitate placement of the device in its operative position on a door knob to enable easy and effective use of the device. The device provides a simple and cost effective means to maintain a door latch in an inoperative position for free movement of the door as desired under many circumstances.

BRIEF DESCRIPTION OF THE DRAWINGS

These and other objects and advantages of the invention will become apparent upon a further reading of the detailed description in conjunction with the accompanying drawings, wherein.

DETAILED DESCRIPTION OF THE INVENTION

Figure 1:
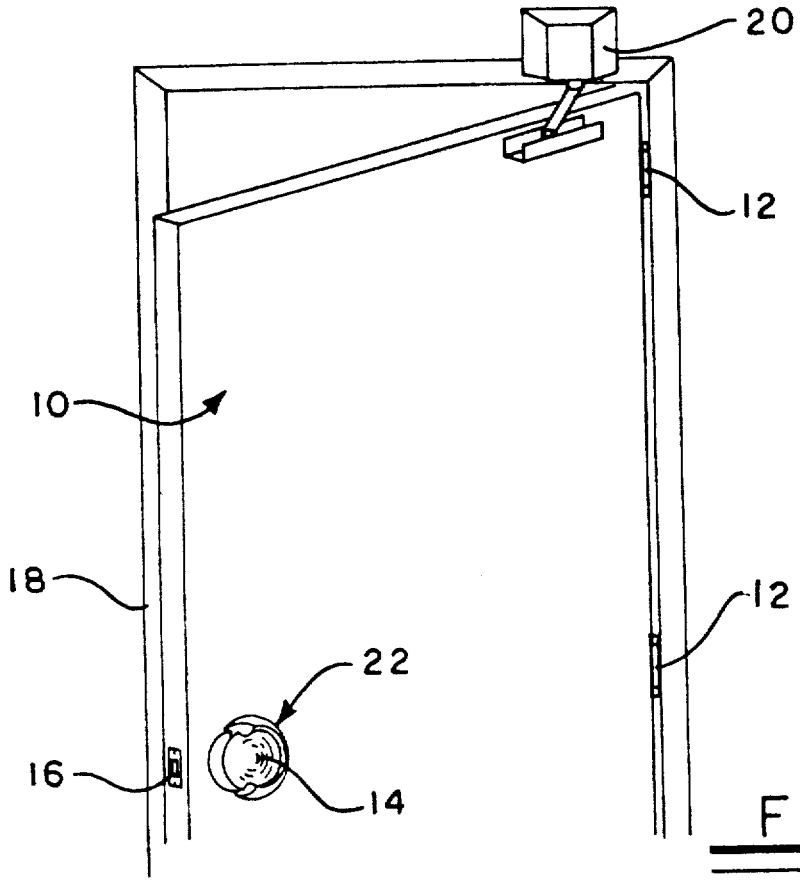
FIG. 1 is a partially cut away perspective view of a door having the door knob and latch retaining device attached thereto so as to render the latch of the door inoperative.

Turning now to FIG. 1, there is shown a conventional door 10 mounted on hinges 12, and having a door knob 14 which is rotatable to operate latch 16 in the conventional manner. The latch 16 coacts with a latch receptacle (not shown) associated with the door frame 18 in which the door 10 is mounted. Also shown in FIG. 1 is an automatic door opening and closing device 20 which is operable from a remote position to affect automatic opening and closing of the door 10. It should be recognized that operation of the automatic opening and closing device 20 will require the door 10 to remain in an unlatched condition with respect to the door frame 18 for operation thereof. In this respect, a door knob and latch retaining device 22 is provided in association with the door knob 14, to render the latch 16 inoperable or to maintain the latch 16 in a non-engaging released position. The latch retaining device 22 operates to allow the door knob 14 to be rotated and maintained in its latch disengaging position for an indefinite period of time as desired.

Figure 2:
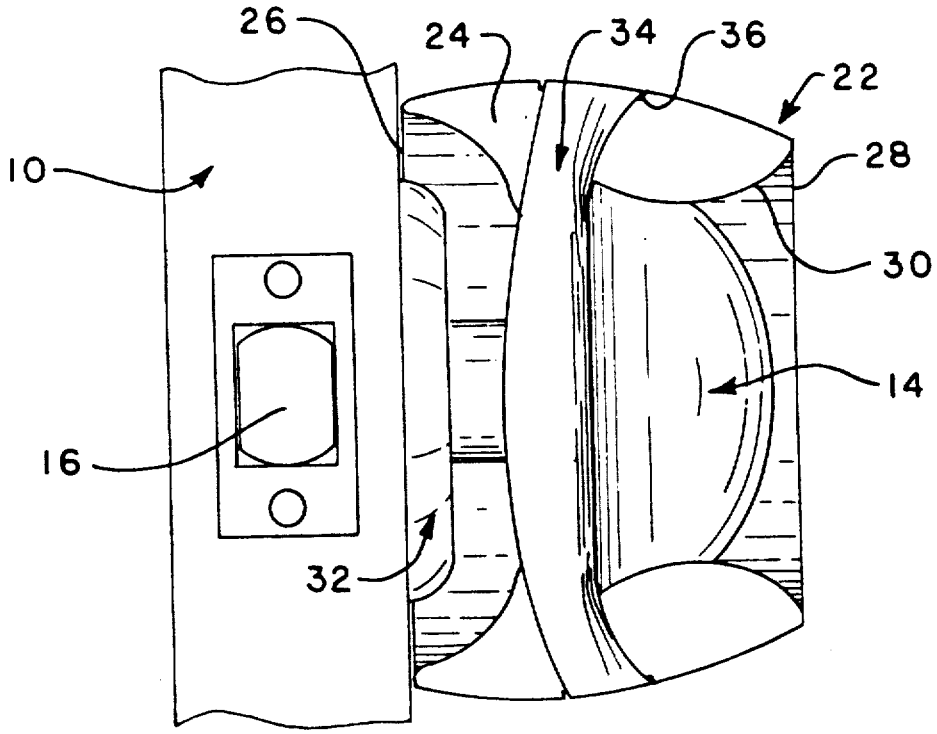
FIG. 2 is an enlarged side elevational view of the door depicted in FIG. 1 with the door knob and latch retaining device in place to render the door latch inoperative, and showing its position on the door knob of the door.

The door knob and latch retaining device 22 is seen in more detail in FIG. 2 with respect to its operation and positioning on the door knob 14 to render the latch 16 inoperative. The door knob and latch retaining device 22 comprises a body member 24 having a first end 26 and a second end 28. In a preferred embodiment, the body member 24 comprises a semi-circular configuration which.. is adapted to extend around and engage approximately half of the door knob 14 on its periphery. The body member 24 may be comprised of an essentially toroidal section, wherein the body member 24 includes an inner surface 30 which is adapted to engage and grip the door knob 14 regardless of the particular shape or design of the door knob utilized. The body member 24 is preferably constructed of a soft resilient material, which may be a rubber or rubber-like material. The body member 24 may be easily constructed of such a soft resilient material by conventional molding techniques or the like, to allow cost effective and efficient manufacturing of the device. As will be described in more detail hereinafter, the inner surface 30 of the body member 24 allows the door knob 14 to be assuredly engaged by the latch retaining device 22 such that rotation of knob 14 will result in similar rotation of the body member 24 along therewith. The body member 24 is also adapted to extend from its knob engaging portion inwardly toward door 10 so as to also engage the outer surface of the door 10 adjacent the door knob 14. Again in the preferred form, the body member 24 is constructed so as to engage the surface of door 10 adjacent to knob 14 about a decorative flange arrangement 32 normally associated with a door knob 14 so as to engage the surface of door 10 directly. It should be recognized that under many circumstances, the decorative flange 32 is not secured to the door 10 in any particular manner and itself may rotate freely. Therefore, it is desirable for the body member 24 to frictionally engage and be retained on the actual surface of the door 10 so as to retain knob 14 in a rotated latch disengaging position.

The way in which the door knob and latch retaining device 22 enables retention of knob 14 in a latch disengaging position relies upon, frictional engagement between body member 24 and knob 14 by means of the inner surface 30 thereof, and frictional engagement between the first end 26 of body member 24 and the surface of the door 10 adjacent knob 14 and flange plate 32. The means by which frictional engagement is achieved is a cincturing means 34 attached to the body member 24 at a predetermined position thereon. The cincuturing means 34 may comprise a Velcro® strap, or a strap having corresponding hook and loop fastening means positioned thereon, such that the strip 34 which extends in a groove 36 frmed in body member 24. The strap 34 has an excess portion which may be wrapped around the door knob 14 and secured to itself on the opposite side of body member 24 so as to tightly draw in body member 24 about the door knob 14. The cincturing means 34 is positioned at a location on body member 24 such that when wrapped around the door knob 14, the strap 34 will extend around the gripping portion of knob 14 in the direction of arrow 38 as seen in FIG. 2. In this way, the cincturing means 34 not only draws the body member inwardly upon itself for frictional engagement with door knob 14, but also acts to draw body member towards the door surface 10 adjacent door knob 14. In this manner, frictional engagement between the first end 26 body member 24 is accomplished. Thus, force is applied inwardly towards the door 10 and downwardly upon the door knob 14 for frictional engagement between body member 24 and the door 10 and door knob 14. Once in the position as shown in FIG. 2, the door knob 14 may be rotated with the knob and latch retaining device 22 into a latch disengaging position where latch 16 will be recessed to render it inoperative, which position may be maintained by the frictional engagement of the device 22 thereon.

Figure 3:
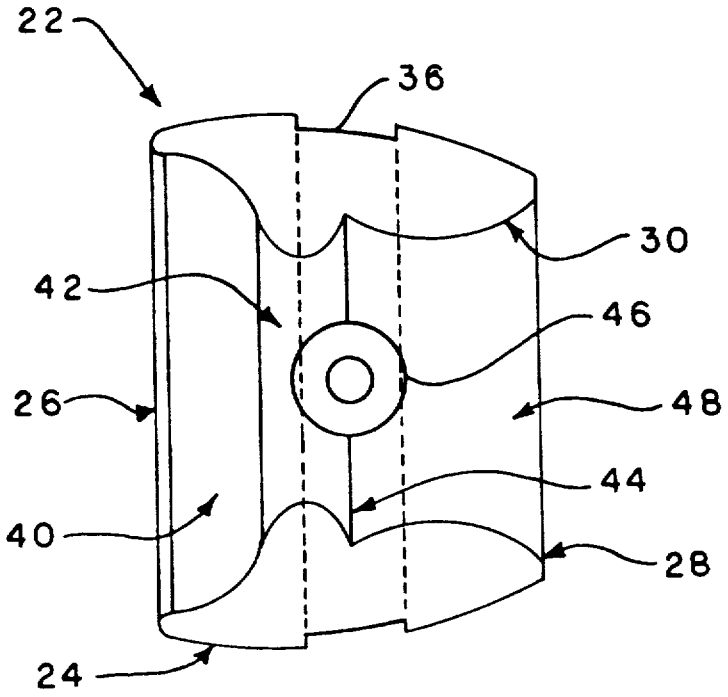
FIG. 3 is a front elevational view of the door knob and latch retaining device of the invention, showing the body member of a preferred body embodiment thereof with the strap retainin m eliminated for clarity.
Figure 4:
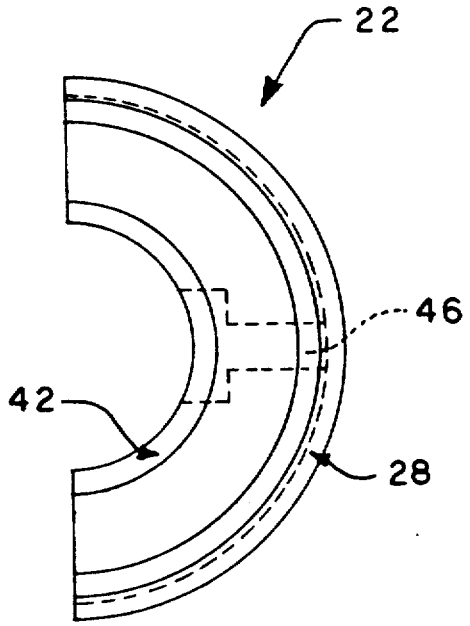
FIG. 4 is a right end elevational view of the body member as shown in FIG. 3.
Figure 5:
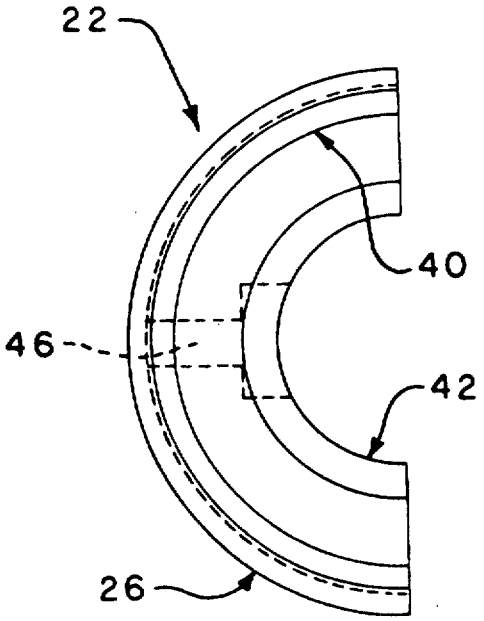
FIG. 5 is a left end elevational view of the body member as seen in FIG. 3.

Turning now to FIGS. 3-5, a preferred embodiment of the latch retaining device will be described in more detail. The cincturing means or strap 34 has been removed for clarity in these figures, but it should be understood that the cincturing means will be positioned at the location of groove 36 as previously described. The body member 24 of the device 22 includes the inner surface 30 which is designed to have a predetermined convoluted shape which has specifically been designed to accommodate a variety of different door knobs while functioning in the preferred manner. The inner surface thus may include a first concave portion 40 adjacent ot first end 26 thereof which is adapted to extend around the flange or face plate of the door knob to enable engagement of the first end 26 with the actual surface of the door adjacent the door knob as previously described. The concave portion 40 is such that it will extend around most any conventional flange or face plate associated with a door knob in the preferred manner. The inner surface 30 next comprises an inwardly extending convex portion 42 which is adapted to seat on the inner side of a door knob and allows the inner surface to properly frictionally engage a wide variety of door knobs as the shape of such door knobs may vary to a considerable extent. Upon cincturing of the body member 24 about a door knob, the projecting portion 42 will be inwardly drawn upon itself and downwardly upon the door knob for frictional engagement with the inner portion of the door knob as desired. Adjacent to the protecting portion 42 is an undercut portion 44 which is adapted to fit between the door knob and the door such that the projecting portion will be better able to be drawn inwardly upon itself and the door knob upon cincturing of the body member 24 about the door knob.

It should be seen that the cincturing means which will be positioned in channel 36 is offset relative to the projecting portion 42, and will extend at approximately the position of the gripping portion of the door knob, such that upon cincturing of body member 24 about the door knob, the cincturing means will be biased inwardly by means of the door knob itself so as to exert an inward force towards the door surface as previously described. The remaining portion of the inner surface 30 comprises a smoothly sloping convex portion 48, which upon cincturing of the body member 24 about a door knob, will frictionally engage the gripping portion of the door knob regardless of the diameter or width thereof. As seen in these figures, there may also be provided a cincturing means retaining device 46 which may simply be a pivet type attachment device which will secure the cincturing means to the body member. As mentioned previously, the cincturing means may be a strap or the like, wherein the rivet type fastening means 46 will allow the strap to be rotated about the device 46 to enable the strap to be wrapped either way around a door knob on which the device 22 is to be used. Thus, the device is easily used by both right and left handed persons and on either side of a door in a convenient and easy manner. Alternatively, the strap may simply be glued into the channel 36 if desired.

The irregularly shaped arcuate inner surface 30 of the body member 24 of the device 22 has been found to assuredly engage a wide variety of door knobs which are available in the marketplace, while allowing the downward and inward forces to be exerted on the door knob and surface of the door adjacent the door knob as desired. In this way, the device 22 is usable to render the door latch of a door inoperative for any of a variety of reasons, such as with use of an automatic door opening and closing device. The door knob and latch retaining device 22 allows the door latch to be rendered inoperative in a simple and cost effective manner at any desired time. The device can maintain the door latch in such inoperative position for an indefinite amount of time, or the device may be removed to render the door and door latch operative in the normal sense. Although the device 22 has been referred to with respect to a preferred embodiment, it should be recognized that the cincturing means may comprise any variety of fastening means which will extend around a door knob and be reattached to the body member so as to frictionally engage the door knob and exert an inward frictionally engaging force upon the door itself.

It should be recognized that based upon the foregoing, the body member 24 of device 22 may be configured differently to accomplish the similar end of maintaining the door knob 14 in a latch disengaging position so as to render the door inoperative. Several alternate embodiments of the device will be described hereinafter, but as to the embodiments shown in FIGS. 3–5, the particular configuration of body member 24 may be altered to exert the similar inward and downward forces as previously described, but acting on a different portion of the door knob 14. For example, the body member 24 may extend outwardly past the door knob 14 and be configured to wrap around, at least to an extent, the door knob 14. In this way, the body member 24 would exert an inward force on the outer most portion of the door knob 14 while maintaining frictional engagement with the surface of door 10 adjacent flange plate 32. Alternative constructions may of course be resorted to accomplish substantially the same functions as the body member 24 described with reference to the preferred embodiment of the invention.

Figure 6:
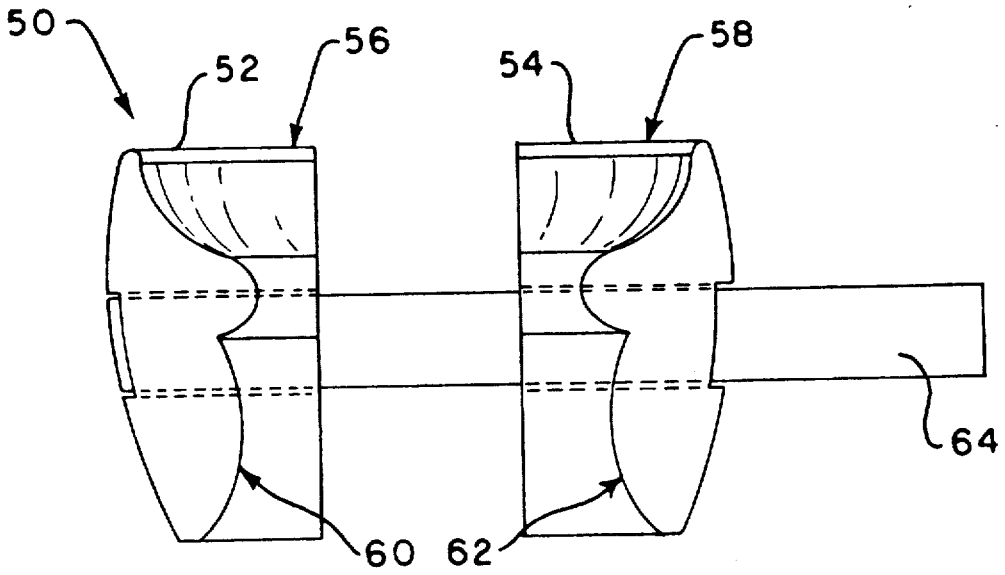
FIG. 6 is an alternate embodiment of the door knob and latch retai device of the invention.

Turning now to FIG. 6, there is shown an alternative embodiment of the door knob and latch retaining device 50 which includes a first body portion 52 and a second body portion 54, each of which includes a first end 56 and 58 respectively which is adapted to frictionally engaged the surface of a door adjacent the door knob thereof as previously described. In this embodiment of the invention, two separate body members are provided to accommodate a wide variance in the shape or style of a door knob with which the device 50 is to be used. Each of the body members 52 and 54 may include inner surfaces 60 and 62 respectively being of irregular arcuate shape, which as depicted in FIG. 6 are similar to the inner surface as previously described. In this embodiment of the invention, body member 52 and 54 are coupled by means of a cincturing strap 64 which again may be a strap or any similar fastening means which can be wrapped around a door knob and fastened to itself on the opposed body member so as to secure the device 50 into proper engagement with a door knob and door. In this embodiment, each of the body members 52 and 54 will frictionally engage a door knob on generally opposed sides of the door knob, wherein the cincturing means 64 will draw the body members towards one another about the knob. Under some circumstances, the door knob may be of such an irregular shape that a semi-circular embodiment as previously described is not readily secured to the knob in its frictionally engaging manner. Under such circumstances, the semi-circular embodiment may be harder to secure to the door knob in its operative position, and may require, for example, the need to pinch in the opposed sides of the first end thereof for proper frictional engagement with the door knob and door. In the embodiment as seen in FIG. 6, such problems which may arise from use of the device on certain irregular door knobs may be avoided, and the device is easily attached and cinctured about the door knob in its frictionally engaging operative position. It should also be apparent that in this embodiment, the materials used to manufacture the device may be minimized for efficient and cost effective production of the device.

Figure 7:
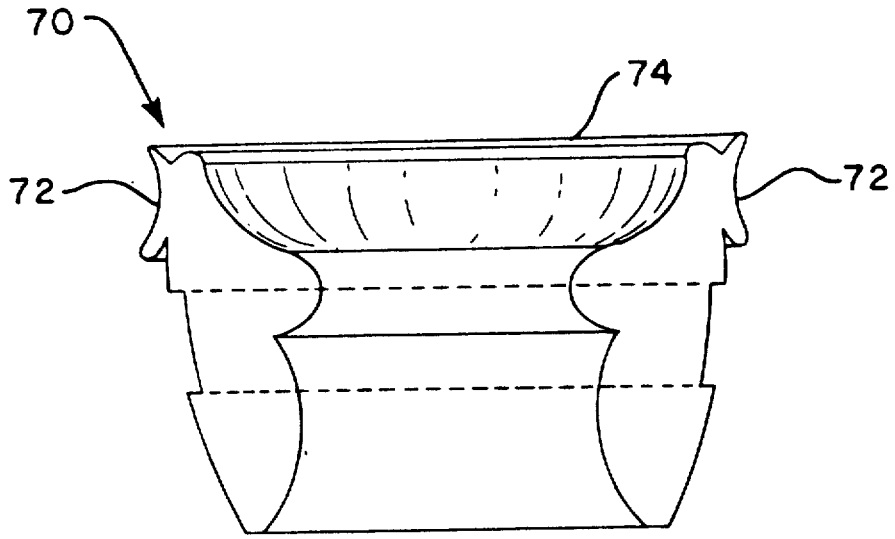
FIG. 7 is yet another embodiment of the door knob and latch retaining device in accordance with the invention.

Turning now to FIG. 7, yet another embodiment of the invention is shown, which in many respects is substantially similar to that described with reference to FIGS. 3–5. As mentioned with respect to the description of the embodiment in FIG. 6, if the device is to be used with an irregularly shaped door knob, or one which dimensionally varies significantly from the conventional door knob, the device may require the application of inwardly directed force at the opposed ends of the semi-circular shape at the first door engaging end thereof. This may be thought of as pinching in these portions of the body member to achieve proper frictional engagement with the door knob about which the device is cinctured and proper frictional engagement with the door itself. In this respect, application of the device to the door knob may be facilitated by the provision of finger pad portions 72 positioned at locations adjacent the first end 74 of the device near the ends of its semicircular shape. The finger pads 72 will thus facilitate pinching in of the ends of the semi-circular shape during cincturing of the device 70 about the door knob for proper frictional engagement therewith.

Figure 8:
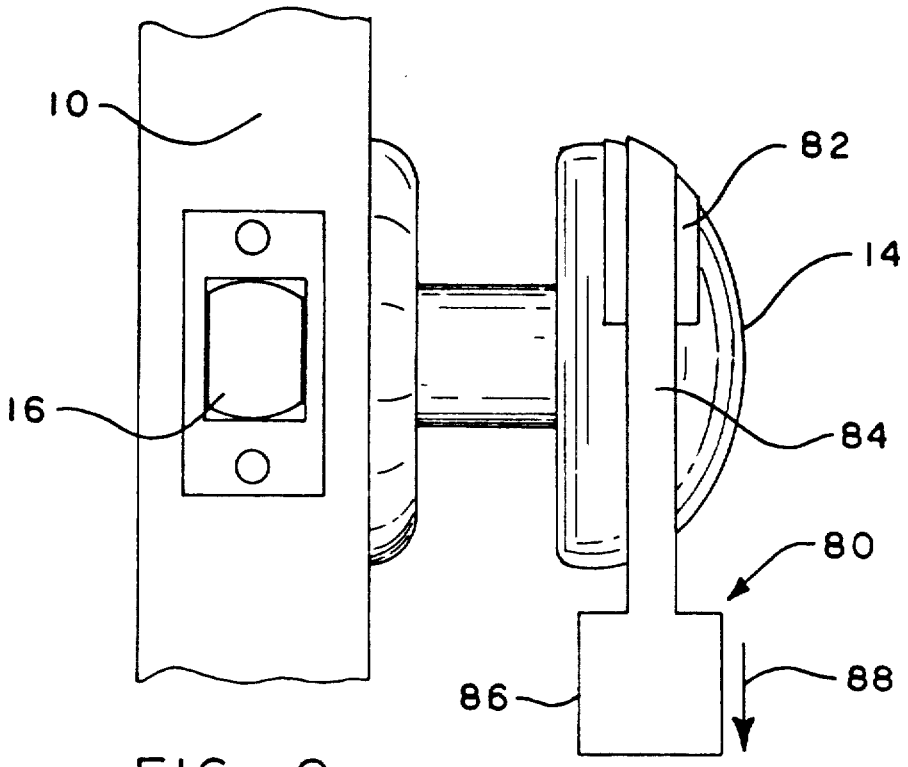
FIG. 8 is still another embodiment of the door knob and latch retaining device having a weight adapted to retain the door knob in a latch disengaging position.

Turning now to still another embodiment of the invention shown in FIG. 8, which is again adapted to retain the latch 16 of a door 10 in an inoperative position similar to that described with reference to FIG. 1. In this embodiment of the invention, the device generally indicated at 80 is adapted to be secured to the door knob 14 of a door 10. The device 80 includes a first body member 82 which is adapted to engage the door knob 14 for rotation therewith. The body member 82 may simply be a strip of rubber-type material which will frictionally engage the knob 14 if secured therearound. The means by which such frictional engagement may be achieved is a cincturing means 84 attached to the body member 82 at a predetermined position thereon. The cincturing means 84 in this particular embodiment may simply be a strap attached to and extending from body member 82 with a Velcro ® or corresponding hook and loop type securing means (not shown) thereon to allow the strap 84 to be wrapped around the door knob 14 and secured to itself on the opposite side of body member 82 so as to create frictional engagement of body member 82 with the door knob 14. It should be recognized that any suitable means for attaching body member 82 to the door knob 14 may be utilized, such that body member 82 becomes frictionally engaged to knob 14 for rotation therewith. Attached to the body member 82, either by means of the strap 84 or any other suitable means, is a second body member 86 which is adapted to exert a predetermined force on the first body member 82. In the preferred embodiment, the second body member is simply a weight which is positioned relative to first body member 82 such that the force of gravity on the weight 86 will exert a downward force on first body member 82 as shown by arrow 88. Once the door knob 14 has been rotated to a latch disengaging position, the second body member will maintain this position through the application of a suitable force on first body member 82 attached to knob 14. It should be recognized that the particular configuration of the device 80 may vary to a great extent, as long as it is attachable to the door knob 14 and exerts a downward force thereon to maintain knob 14 in a latch disengaging position.

Figure 9:
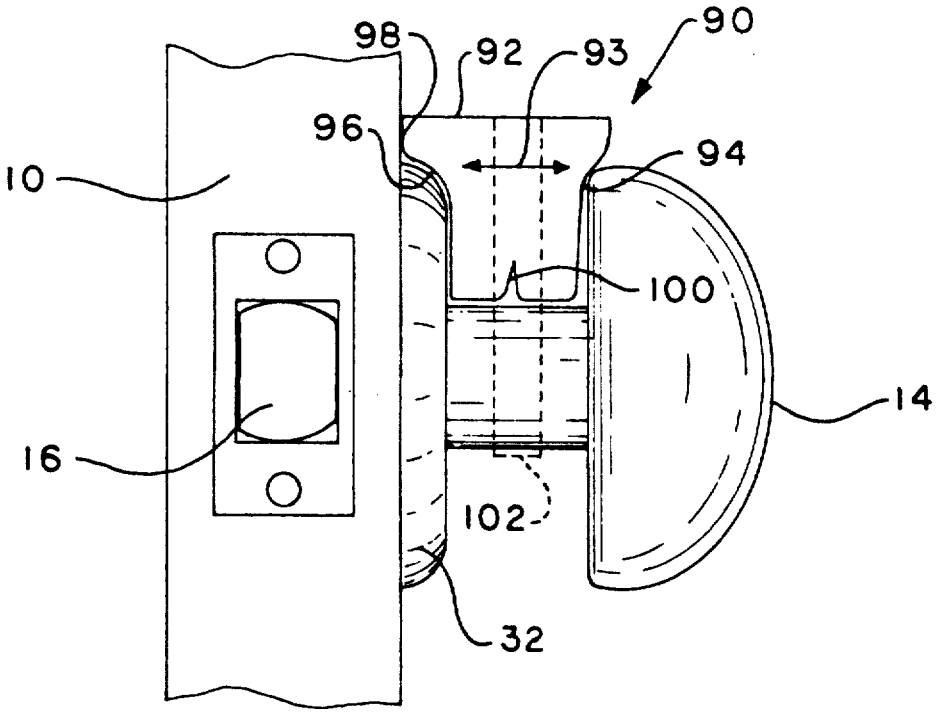
FIG. 9 is still another embodiment of the door knob and latch retaining device.

Turning now to FIG. 9, there is shown yet another embodiment of the invention which allows the latch 16 of door 10 to be maintained in a disengaged position to allow free opening and closing of the door 10 as previously described. In this embodiment, the latch retaining device 90 comprises at least one body portion 92 which is adapted to the wedge between the surface of the door 10 adjacent knob 14 and flange plate 32 of door 10 and the inner portion of door knob 14. The body member 92 is configured so as to exert forces outward therefrom and toward the surface of the door 10 and the inner portion of knob 14 as shown by arrow 93, so as to maintain the knob 14 in a latch disengaging position relative to door 10. Again, the body member 92 may be constructed of a soft resilient material, such as a rubber or rubber-like material, so as to allow frictional engagement between body member 92 and the surface of the door 10 adjacent knob 14 and flange plate 32. The configuration of the body member 92 is such that it can be wedged in the space between the door surface adjacent knob 14 and flange plate 32 and knob 14, which under most circumstances is relatively consistent with conventional doors. To accommodate slightly varying distances between the door surface adjacent knob 14 and flange plate 32 and inner surface of a door knob 14, the body member 92 may have a rounded surface 94 in relation to the door knob 14 to allow this surface to frictionally engage the door knob 14 regardless of its shape or distance from the door surface. The body member 92 may also include a hollowed out portion 96 adjacent the flange plate 32 of the door knob 14 as well as an extending portion 98 which is adapted to extend around the flange plate 32 and engage the surface of the door 10. The resilient material from which body member 92 is made will itself provide a restoring force such that when body member 92 is wedged between the door surface and door knob 14, this restoring force will exert pressure therebetween. Thus, when the door knob 14 is rotated to render the latch 16 inoperative, the body member 92 will exert a suitable force to maintain the latch disengaging position as desired.

To increase the restoring force generated by the body member 92, a gap 100 may be formed in the body member 92 such that when it is wedged in the space between the door surface and door knob 14, the gap 100 will deform slightly to close the gap and an additional amount of restoring force will be provided to insure that the proper amount of force to maintain the door knob 14 in a latch disengaging position is provided by the device 90. The device 90 may further include a retaining strap or cincturing means 102 which will facilitate maintaining the body member 92 in its wedged position between the door surface and door knob 14. Again, the retaining strap 102 may be a Velcro ® strap or a strap having corresponding hook and loop type fastening means thereon to easily allow the body member 92 to be wedged into its position and maintained by means of the strap as desired. It is further noted that the strap 102 may not be necessary as the frictional engagement between body member 92 and the door surface of knob 14 may be sufficient to maintain it in its operative position. It again should be recognized that the particular configuration of body member 92 may vary while accomplishing the essential characteristics of the device 90.

It should be evident from the foregoing that although the device has been described with reference to particular preferred embodiments thereof, a variety of modifications or alternate constructions would be evident to one skilled in the art and are embodied within the spirit and scope of the invention as expressed in the appended claims.

What is claimed is:

1. A door latch retaining device that does not engage a latch bolt comprising, at least one body member having at least a portion thereof constructed of a resilient material adapted to frictionally engage a door knob, said at least one body member having means associated therewith for exerting a predetermined force on said door knob through said at least one body member, wherein when said door knob is rotated to a latch disengaging position, said means for exerting a predetermined force on said door knob enables said door knob to be retained in its latch diseagaging rotated position.

2. A door latch retaining device as in claim 1, wherein, said at least one body member has an inner surface adapted to frictionally engage said door knob, and first and second ends with said first end adapted to frictionally engage a door adjacent said door knob, wherein said means for exerting a predetermined force comprises said body member which creates frictional engagement between said door and said door knob so as to retain said door knob on said latch disengaging rotated position.

3. A door latch retaining device as in claim 1, further comprising, a cincturing means to secure said at least one body member about said door knob in a frictionally engaging position.

4. A door latch retaining device as in claim 2, wherein, said inner surface is an irregular surface comprising an outwardly extending convex portion adapted to frictionally engage a door knob on an inner surface thereof adjacent the door, and a second outwardly extending convex portion adapted to frictionally engage a door knob at its widest portion such that said inner surface will frictionally engage said door knob.

5. A door latch retaining device as in claim 2, wherein, said inner surface includes a first concave portion adjacent said first end adapted to extend around a faceplate of said door knob to enable engagement of said first end with said door.

6. A door latch retaining device as in claim 2, wherein, said inner surface is an irregular arcuate shape having a first portion thereof adapted to frictionally engage said door knob, and a second portion is adapted to extend around a flange associated with said door knob to allow said first end to be frictionally engaged with the surface of said door.

7. A door latch retaining device as in claim 3, wherein, said means for cincturing comprises a strap which is adapted to extend from one edge of said body member around said door knob and be secured to said body member at the other edge thereof.

8. A door latch retaining device as in claim 7, wherein, said strap extends from a position on said body member relative to said door knob so as to impart an inward force on said body member toward said door.

9. A door latch retaining device as in claim 1, wherein, said means for exerting a predetermined force on said door knob through said at least one body member comprises a weight means attached to said at least one body member which is adapted to exert a downward force on said at least one body member to maintain said door knob in said latch disengaging rotated position.

10. A door latch retaining device as in claim 1, wherein, said at least one body member has an irregular inner surface which is adapted to be wedged between the surface of a door adjacent said door knob and an inner surface of said door knob, with said means for exerting a predetermined force on said door knob comprising a surface of said at least one body member exerting an outward force on said door knob so as to retain said door knob in said latch disengaging rotated position.

11. A device for retaining a door knob on a door in a latch disengaging position without engaging a latch botl comprising:

a body member, said body member being constructed at least in part of a resilient material and having first and second ends and inner and outer surfaces said body member adapted for gripping a door knob by means of said resilient material, and exerting a predetermined force on said door knob;

and means for cincturing said body member securely around said knob such that said predetermined force is exerted upon said door knob to retain said door knob in a latch disengaging position.

12. A device according to claim 6 wherein said device is made out of a flexible elastic rubber material.

13. A device according to claim 6 hving a strap including corresponding hook and loop or VELCRO® fastening means provided thereon to act as a means for cincturing said member securely around said knob.

14. A device according to claim 3, wherein said cincturing means is secured to said body member by a pin such that said cincturing means cn be rotated around the circumference of the device.

15. A door latch retaining device as in claim 11, wherein said body member has a weight attached thereto such that said predetermined force is exerted as a downward force on said body member.

16. A door latch retaining device as in claim 11 wherein, said body member is wedge shaped and has a first end adapted to frictionally engage a door adjacent said door knob and a second end adapted to frictionally engage an inner surface of said door knob, wherein said body member is made out of a resilient material and includes a strap that holds body member in a wedged position between said door and said inner surface of said door knob.

17. A door latch retaining device as in claim 16, wherein, said body member includes an irregularly shaped gap on its inner surface.

18. A door latch retaining device as in claim 11, wherein said body member is adapted to frictionally engage a surface of the door adjacent said door knob, and also is adapted to frictionally engage said door knob such that such predetermined force is exerted between said surface of said door and said door knob.

19. A door latch retaining device as in claim 18, wherein, said predetermined force is directed outward from said door surface onto said door knob.

20. A door latch retaining device as in claim 18, wherein,k said predetermined force is directed inwardly onto said door knob toward said surface of said door.

* * * * *